US005617993A

United States Patent [19]

Morris

[11] Patent Number: 5,617,993

[45] Date of Patent: Apr. 8, 1997

[54] LOCKING MAILBOX

[76] Inventor: Glenn Morris, 8080 Banks Mill Rd., Douglasville, Ga. 30135

[21] Appl. No.: 341,412

[22] Filed: Nov. 16, 1994

[51] Int. Cl.[6] ..... B65D 91/00

[52] U.S. Cl. ..... 232/27; 232/20

[58] Field of Search ..... 232/17, 20, 27, 232/29, 38

[56] References Cited

U.S. PATENT DOCUMENTS

| | | | |
|---|---|---|---|
| 166,623 | 8/1875 | Miller | 232/17 |
| 210,253 | 11/1878 | Hale | 232/17 |
| 380,148 | 3/1888 | Thompson | 232/45 |
| 584,137 | 6/1897 | Willinger et al. | 232/17 |
| 693,770 | 2/1902 | Wright et al. | 232/17 |
| 827,482 | 7/1906 | Van Dorn | 232/17 |
| 1,261,187 | 4/1918 | Thackray | 232/33 |
| 1,520,544 | 12/1924 | Mezei | 232/17 |
| 3,401,875 | 9/1968 | Bruhns | 232/34 |
| 3,735,919 | 5/1973 | Morgan | 232/17 |
| 3,758,027 | 9/1973 | Morgan | 232/17 |
| 3,874,583 | 4/1975 | Moll | 232/17 |
| 3,880,344 | 4/1975 | Earle | 232/17 |
| 4,724,999 | 2/1988 | Fitzgerald et al. | 232/17 |
| 4,993,626 | 2/1991 | Berry | 232/17 |
| 5,003,378 | 3/1991 | Dorr et al. | 232/17 |
| 5,056,711 | 10/1991 | Bush | 232/17 |
| 5,071,063 | 12/1991 | Overstreet | 232/17 |
| 5,096,115 | 3/1992 | Hassan | 232/17 |
| 5,148,974 | 9/1992 | Clapper | 232/17 |

OTHER PUBLICATIONS

Step 2 catalog excerpts (3 pages), 1994.

Lawn and Garden Catalog Excerpt (1 page) p. 11, no date.

*Primary Examiner*—Michael J. Milano

*Attorney, Agent, or Firm*—Hopkins & Thomas

[57] ABSTRACT

A locking mailbox (5) for receiving mail and other deliveries, to include newspapers and magazines, in a weather and theft resistant enclosure having a generally upright housing (7), a bottom compartment (8), and a separate top compartment (9), defined within the housing. An elongated mail slot (26) is closed on the bottom compartment by an elongated flap (28) through which mail and deliveries are passed into the bottom compartment. Bottom compartment (8) has a generally rectangular side opening (32) defined therein, opening (32) having a pair of parallel and spaced part recessed side edges (33) and a recessed top edge (34) for receiving lockable door (36) flush on the housing, the door being movable from an open position into a closed position locked on housing (7) for enclosing bottom compartment (8). Top compartment (9) is formed as an elongated tubular body above the bottom compartment and is completely separate from bottom compartment (8). The top compartment has an open end (47) through which access to mail or other articles to be picked up for delivery by the letter carrier is provided. Top compartment (9) extends beyond front panel (12) of housing (7), and forms a protective lip (46) for sheltering mail slot (26).

10 Claims, 2 Drawing Sheets

LOCKING MAILBOX

FIELD OF THE INVENTION

This invention relates in general to mailboxes. More particularly, this invention relates to a locking mailbox having two separate compartments, a locked compartment for receiving mail and other deliveries in a secure weather resistant, and theft resistant locking enclosure, and an unlocked compartment for holding outgoing mail.

BACKGROUND OF THE INVENTION

Mailboxes are known in the art. In rural and suburban environments mailboxes by the side of the street are a common phenomenon. Street side mailboxes serve two important and primary purposes, the first of which is to receive mail and other deliveries, to include newspapers, magazines, and like, and the second of which is to provide a deposit point for outgoing mail and parcels for pick up by the letter carrier as he or she makes their rounds.

Although federal lairs exist that punish the theft of mail, problems with theft of mail, particularly financial documents such as social security, retirement, and pension checks, as well as financial statements to include bank documents and credit cards, exist. Suburban and rural mailboxes are also subject to vandalism and destruction, to include the placement of explosive devices inside mailboxes by those bent on acts of mischief and vandalism.

A number of approaches have been taken in the attempt to provide a secure and accessible mailbox which also preventing the theft of mail and other deliveries held inside the mailbox. One of these mailboxes is disclosed in the patent to Bern. U.S. Pat. No. 4,993,626, disclosing a security mailbox for the storage of mail in a secure lower portion of a housing, the mailbox having a pivoting mail shelf to divide the housing into upper and lower compartments with the mail shelf being moved from a substantially horizontal rest position to a downwardly inclined main dump position. In Berry, however, the mailbox housing has only a single compartment defined therein, into which not only mail, but other objects, such as, for example, explosive devices for the purposes of vandalism, can be inserted into the mailbox.

Similarly, the secured mailbox of Fitzgerald et al. U.S. Pat. No. 4,724,999, discloses a mailbox or receptacle for mail which has two compartments in communication with each other, an unsecured upper compartment and a locked lower compartment with a movable partition between the two compartments. In Fitzgerald et al., an opening in the partition accesses a chute extending downwardly from the upper compartment into the lower compartment, the chute being set at an angle which allows mail and papers to pass from the upper to the lower compartment.

The patent to Overstreet. U.S. Pat. No. 5.071,063, is similar to the patents to Berry and Fitzgerald in that it discloses a housing having a mail delivery door through which mail is placed into the housing and passed downwardly into the bottom of the housing. However, Overstreet has only a single, or common compartment, defined in the housing of the mailbox.

Another approach taken to deal with the problem of protecting mail is shown in the patents to Bruhns, U.S. Pat. No. 3,401,875, Morgan, U.S. Pat. No. 3,735,919, and Morgan, U.S. Pat. 3,758,027. In each of these three patents a mailbox having upper and lower compartments is disclosed, where a trap door mechanism separates the upper compartment from the lower compartment so that once mail is placed into the upper compartment and the actuating mechanism is operated by the closing of the mail delivery door or other means, a trap door opens, and the mail passes into a lower compartment. However, and like the mailboxes of Berry, Fitzgerald et al., and Overstreet, once a package or other delivery is placed in the mailbox, to include unauthorized deliveries placed in the mailbox, the opening of the trap door passes the articles into the lower compartment. Also, and due to the nature of their construction, the mailboxes to Bruhns and Morgan are relatively complicated in nature, having a number of mechanical parts interlinked and operated upon opening of the mailbox door or through the use of an actuating mechanism, the mechanisms thus being subject to wear.

None of the prior art known to the inventor discloses or illustrates a locking mailbox having two separate compartments, a secured and enclosed lower compartment for receiving mail and other authorized deliveries, and a separate top compartment to hold outgoing mail and parcels which is not dependent on a spring lock or other mechanism to hold the outgoing mail in position, and which does not permit access to the lower compartment after outgoing mail is picked up for delivery. Thus, the need exists for an improved and simple locking mailbox which is adapted to house mail and authorized deliveries in a secure, locked, weather and theft resistant enclosure sized large enough to allow mail to accumulate over a period of time, and which also provides a simple device for holding outgoing mail which does not depend on any operating mechanism nor provide access to the secured and enclosed compartment holding the delivered mail.

SUMMARY OF THE INVENTION

The present invention provides an improved locking mailbox which overcomes some of the design deficiencies of other locking mailboxes known to the art by providing a mailbox having a generally upright housing, the housing having two separate compartments, a top compartment and a bottom compartment, defined within the housing, wherein both compartments are separate from the other and no access is available through one compartment into the other.

The housing has an elongated mail slot defined in the bottom compartment for passing mail and deliveries into the bottom compartment, as well as an elongated flap sized and shaped to close on the mail slot. A generally rectangular opening is defined in the bottom compartment through which mail and deliveries into the mailbox may be removed from the housing, as well as a lockable door sized and shaped to fit within the opening, the door including a lock formed as a part thereof for locking the door in a closed position on the bottom compartment thus enclosing the bottom compartment.

The top compartment is defined above the bottom compartment within the housing, the top compartment having an open end on the side of the housing in which the mail slot is defined for holding outgoing mail to be picked up by the letter carrier on his or her daily rounds. In addition, a portion of the top compartment forms a protective edge or lip extending beyond the front face of the mailbox housing in which the mail slot is defined to protect the mail slot from the elements.

Mail is passed through the mail slot yieldably urging the flap open as mail and other deliveries are passed therethrough into the lower compartment, and are held in the lower compartment until such time as an authorized user, a key holder, opens the lockable door in the bottom compartment and removes the mail and other deliveries.

Thus, it is an object of the instant invention to provide an improved locking mailbox having separate compartments for housing mail and other deliveries in a secure and enclosed compartment formed inside a weather and theft resistant enclosure, and an open compartment for holding outgoing mail.

Another object of the invention is to provide an improved mailbox which is not dependent on the opening or movement of doors or flags for actuating a mechanism formed as a part of the mailbox to hold outgoing mail or to pass delivered mail into a lower or secured compartment.

Still another object of the instant invention is to provide a mailbox having a lockable door provided in the side of the housing so that the mailbox owner does not need to enter the street or road in front of the mailbox to retrieve mail after delivery by the postman.

A further object of the invention is to provide an improved locking mailbox which can accumulate mail delivered over a period of time so that the mailbox does not provide a visual signal to potential burglars or thieves that the mailbox owner is not home.

An additional object of the invention is to provide a mailbox that has a secured, locked storage compartment in which the mail deposited therein is held out of sight and out of reach from outside the mailbox, yet which does not require a key or the actuation of a mechanism by a delivery person to deposit mail or other items therein.

A further object of the invention is to provide a mailbox that can be used as a conventional mailbox for sending and receiving mail in a conventional manner if so desired.

A further object of this invention is to provide an improved mailbox which is simple in design and operation, is inexpensive to construct, and is durable and rugged in structure.

These and other objects, features, and advantages of the invention will become apparent upon reading the specification when taken in conjunction with the accompanying drawings, wherein like characters of reference designate corresponding parts through the several views.

DETAILED DESCRIPTION

Figure 1:
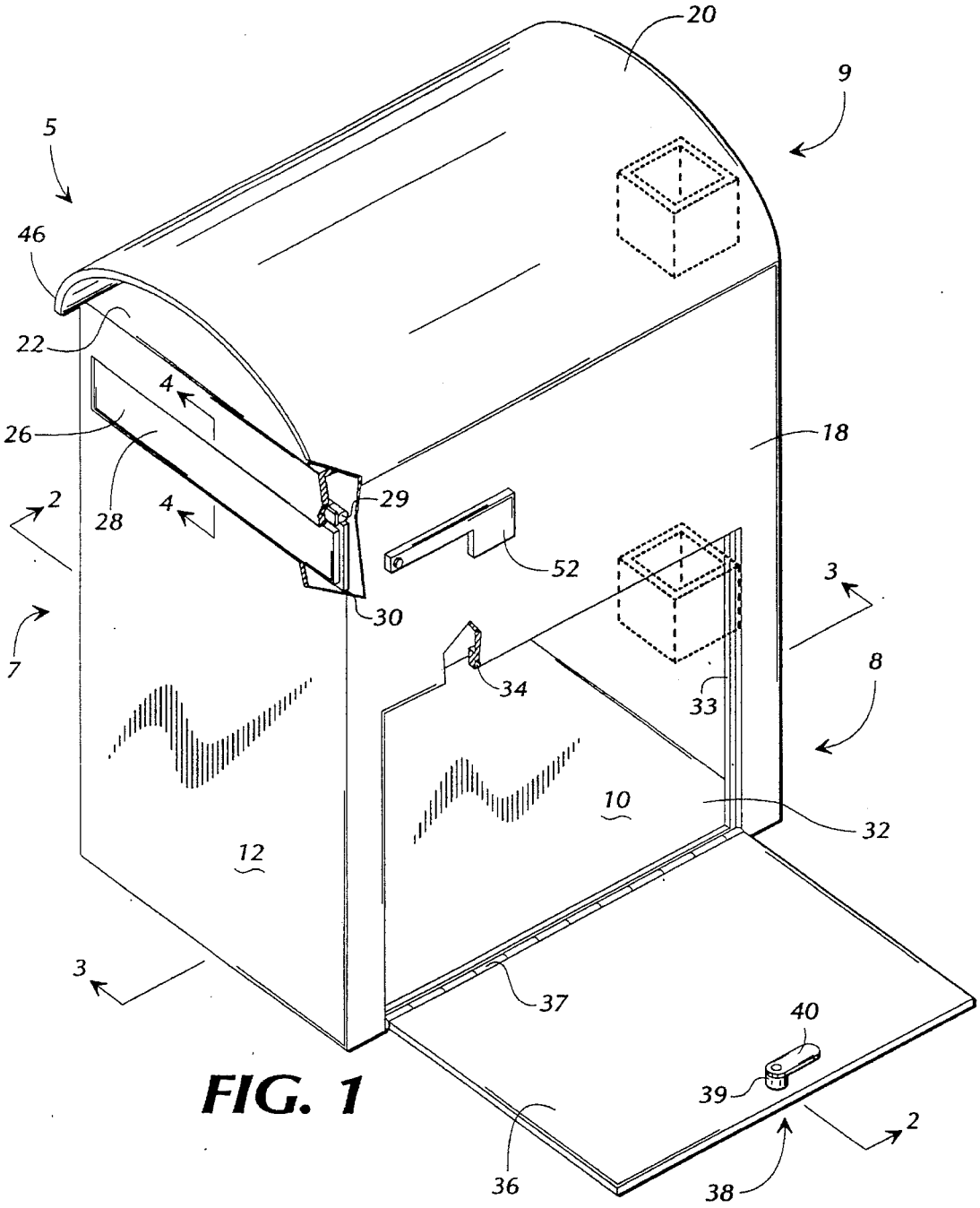
FIG. 1 is a perspective view of a preferred embodiment of a locking mailbox with the lockable door of the mailbox shown in its open position.
Figure 2:
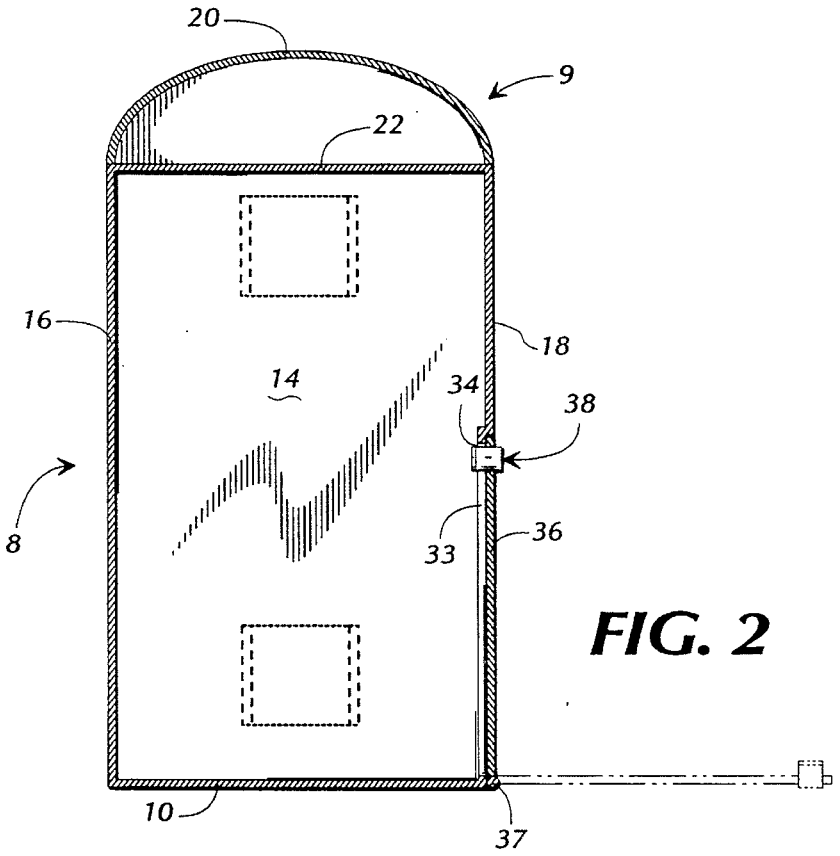
FIG. 2 is a front elevational cross-section view of the mailbox along line 2—2 of FIG. 1.
Figure 3:
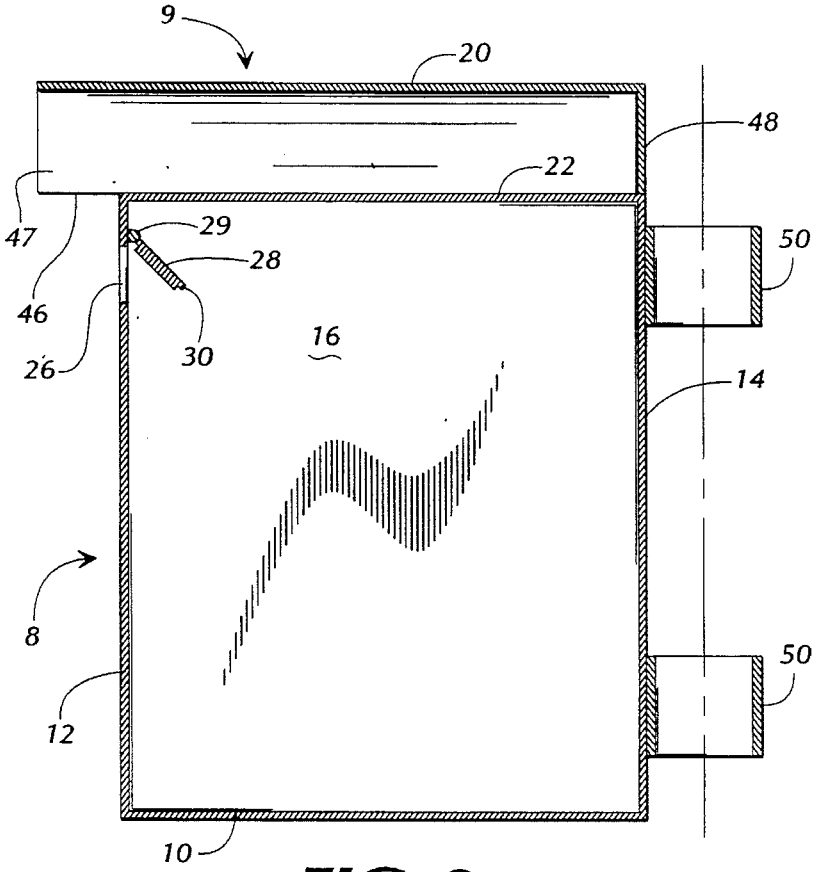
FIG. 3 is a side elevational cross-section view of the mailbox along line 3—3 of FIG. 1.

Referring now in detail to the drawings in which like reference numerals indicate like parts throughout the several views, numeral 5 of FIG. 1 illustrates a preferred embodiment of a locking mailbox. As best shown in FIGS. 1, 2 and 3 locking mailbox 5 has a housing 7, with a bottom compartment 8, and a top compartment 9 formed within housing 7.

Still referring to FIGS. 1 to 3, housing 7 is constructed as a generally upright enclosure having a generally horizontal and rectangular bottom panel 10, an upright front panel 12, a spaced part and upright rear panel 14, and a pair of generally upright and spaced part side panels 16 and 18. A generally horizontal top panel 20 also forms a part of housing 7. Front panel 12, rear panel 14, and side panels 16 and 18 being attached to bottom panel 10 along their common horizontal edges, and front panel 12, rear panel 14, and side panels 16 and 18 being connected to each other along their common vertical edges. Front panel 12, real panel 14, side panels 16 and 18 are also attached to top panel 20 along their common horizontal edges, thus forming housing 7. Inside housing 7 is a generally horizontal separation panel 22, attached to front panel 12, rear panel 14, and side panel 16 and 18 along their common horizontal edges. Separation panel 22 thus forms bottom compartment 8 and top compartment 9 within housing 7, wherein top compartment 9 is separate from bottom compartment 8, and there is no method or manner of passing mail from the top compartment into the bottom compartment and vice versa. Separation panel 22 also forms the outgoing mail shelf for holding outgoing mail to be withdrawn from top compartment 9 by the letter carrier during his or her daily deliveries.

Figure 4:
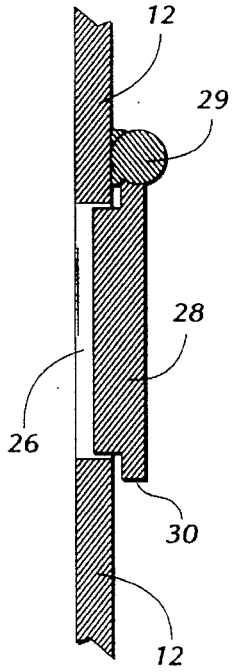
FIG. 4 is a partial side cross-sectional view of the mail slot and flap along line 4—4 of FIG. 1.

Referring now to FIGS. 1 and 3, an elongated and generally rectangular mail slot 26 is defined within front panel 12, parallel to bottom panel 10, and in spaced relationship to top compartment 9. A flap 28 size and shaped to close on mail slot 26 is also provided, flap 28 being pivotally supported inside front panel 12 of housing 7 within bottom compartment 8, by an elongated hinge 29. It is anticipated that hinge 29 will be an elongated piano type hinge, but any conventional hinge adapted for outdoor use will suffice. Flap 28 has a lip 30 formed along its bottom edge (FIG. 4) for closing mail slot 26 in and on front panel 12. Flap 28 is biased into a closed position on mail slot 26 through the weight of flap 28, and by its construction, where hinge 29 is positioned above mail slot 26. Flap 28 is sized and shaped to be yieldably urged open as mail and deliveries are passed through mail slot 26 by pushing flap 28 rearward as shown by the directional arrow in FIGS. 3 and 4, until the mail and other deliveries have passed into bottom compartment 8, whereupon flap 28 closes itself on mail slot 26, and thus encloses bottom compartment 8 within housing 7.

As best shown in FIGS. 1 and 2, a side opening 32 is defined within one of side panels 16, 18, in this instance side panel 18, for removing mail and other deliveries from bottom compartment 8. Although shown here in a side panel, opening 32 can be defined in front panel 12 or rear panel 14, if so desired. It is anticipated, however, that opening 32 will be in one of side panels 16, 18.

A feature of side opening 32 is that it has two parallel and spaced apart recessed side edges 33, and recessed top edge 34, so that opening 32 is recessed into side panel 18, where lockable door 36 fits flush with side panel 18 within side opening 32. This is best shown in FIG. 2, in which lockable door 36 is shown in its closed position on side panel 18, so that lockable door 36 fits flush within the recess formed by recessed edges 33 and 34, and thus fits flush within side panel 18 so that lockable door 36 is sealed on recessed edges 33 and 34, which in essence act as sealing flanges, for providing improved weather resistance to protect mail held in bottom compartment 8, as well as making it more difficult to pry, lockable door 36 open in order to gain unauthorized access to bottom compartment 8. As best shown in FIGS. 1 and 2, lockable door 36 is supported on housing 7 by an elongated hinge 37, in this instance an elongated piano type hinge, so the lockable door 36 moves from a closed position (FIG. 2) to an open position (FIG. 1).

Lockable door 36 has a locking mechanism 38 provided as an integral part thereof, so that lockable door 36 may be locked into its closed position (FIG. 2) on bottom compartment 8. As shown in FIGS. 1 and 2, locking mechanism 38 in this embodiment has a cylinder lock 39, and an arm 40 which rotates with the movement of cylinder lock 39 so that arm 40 is in a generally upright position (not illustrated) when lockable door 36 is locked on the side of side panel 18 of housing 7, arm 40 rotating through an arc of approximately 90° into an open position when lockable door 36 is opened (FIG. 1).

Figure 5:
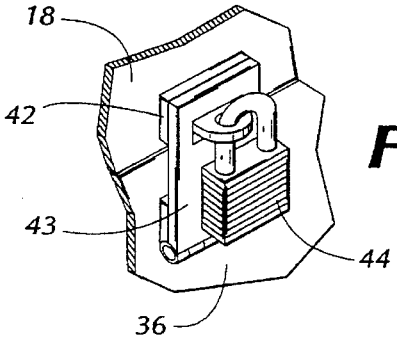
FIG. 5 is a partial perspective view of an alternate arrangement for locking the lockable door of the mailbox in its closed position on the bottom compartment of the mailbox.

Turning to FIG. 5, an alternate locking mechanism 38 is illustrated. Here a hasp 42 and matching portion of the hasp 43 are each fastened to lockable door 36 and side panel 18, respectively, with a padlock 44 placed through hasp 42, 43 for locking lockable door 36 in its closed position on housing 7. It is anticipated that hasp 42 and 43 can either be screwed, bolted, or riveted onto lockable door 36 and side panel 18.

As best illustrated in FIG. 3, top compartment 9 is an elongated tubular body which protrudes beyond front panel 12, thus forming a protective lip 46 which extends beyond front panel 12 and mail slot 26 for sheltering mall slot 26 from the elements. Still referring to FIG. 3, top compartment 9 has an open end 47 on the side of housing 7 in which mail slot 26 is defined, and a closed end 48 formed in the top compartment by rear panel 14 extending upward beyond separation panel 22. Thus constructed, separation panel 22 acts as the outgoing mail shelf for top compartment 9, mail being accessed through open end 47 and withdrawn outward by the letter carrier.

Still referring to FIG. 3, mailbox 5 also has at least one post support bracket 50, here two post support brackets 50 are shown, so that a conventional support post (not illustrated) mounted in the ground and extending up,yard can be passed through post support brackets 50, or post support brackets 50 can be passed down over the support post, for supporting mailbox 5 at the appropriate height above the ground for the purpose of receiving mail and other deliveries at the heights prescribed by the U.S. Postmaster. Lastly, and as shown in FIG. 1, mailbox 5 also has a flag 52 for signaling the presence of mail within top compartment 9 to be picked up by the letter carrier.

Housing 7, to include bottom panel 10, front panel 12, rear panel 14, side panels 16 and 18, top panel 20, separation panel 22, lockable door 36, and post support brackets 50 can be conventionally formed of galvanized metal typically associated with street side mailboxes, but will preferably be made of a durable, rigid and weather resistant plastic for improved weather resistance, and for resistance to vandalism or attack, modern plastics being well suited to this task. Flap 28 can be made of a metal or plastic, and preferably will be made of the same plastic material of which mailbox 5 is constructed, although it is possible that flap 28 could be made of brass or some other decorative metal for appearance purposes.

Hinges 29 and 37 are conventional hinges adopted for outdoor use and are preferably a piano type hinge extending along the entire length of flap 28 and the bottom edge of lockable door 36, respectively. Hinges 29 and 37 will be conventionally fastened within the inside of bottom compartment 8, as well as to flap 28 and lockable door 36, respectively. By screws, bolts, rivets, or by chemical bonding or welding. It is also possible that mailbox 5 will be so constructed that hinges 29 and 37 will fit within recessed slots made in the mailbox, or that the hinges will be cast or molded into and form a part of the mailbox.

Locking mechanism 38 can be any conventional keyed cylinder lock adapted for outdoor use. Flag 52 will be pivotally attached (not illustrated) to housing 7 and movable from a downward position into an upward position to signal the presence of mail in top compartment 9 for pickup by the letter carrier.

Mail slot 26 defined in front panel 12 will preferably be shaped to be two inches high and eleven inches wide so that mail deliveries, to include newspapers or magazines, can be passed through mail slot 26 into bottom compartment 8.

While a preferred embodiment of the invention has been disclosed in the foregoing specification, it is understood by those skilled in the art that variations and modifications thereof can be made without departing from the spirit and scope of the invention, as set forth in the following claims.

I claim:

1. A locking mailbox for receiving mail and other deliveries, to include newspapers and magazines, in a weather and theft resistant housing, comprising:

a generally upright housing, the housing having a top compartment and an enclosed bottom compartment;

an elongated mail slot defined in the bottom compartment for passing mail and deliveries into the bottom compartment, said slot being located in the top of the bottom compartment in spaced relationship to the top compartment;

an elongated flap sized and shaped to cover the mail slot, the flap being pivotally supported on the inside of the housing in overlapping fashion over the mail slot for closing the mail slot;

a generally rectangular opening defined in the bottom compartment;

a lockable door sized and shaped to fit within said opening, the door being pivotally supported on the housing and including locking means for locking the door in a closed position on the housing;

therein the top compartment is formed as a tubular body having an open end on the side of the housing in which said mail slot is defined for holding outgoing mail, a protective lip formed as a portion of the top compartment, said lip extending beyond the housing for sheltering the mail slot from the elements;

whereby outgoing mail can be placed under cover in the top compartment awaiting pick up by the postal service, while mail and other deliveries are passed through the mail slot into the bottom compartment and held therein until the locking door of the mailbox is unlocked and opened and the contents of the bottom compartment removed.

2. The mailbox of claim 1, wherein said housing comprises:

a generally horizontal and rectangular bottom panel;

a pair of generally upright and spaced apart side panels;

a generally upright front panel;

a generally upright rear panel, the rear panel being spaced apart from the front panel; and a generally horizontal top panel, the top panel being spaced apart from the bottom panel;

wherein the front, side, and rear panels are joined to the bottom panel along their common horizontal edges, the front, side, and rear panels are joined to each other along their common vertical edges, and where the front, side, and rear panels are joined to the top panel along their common horizontal edges.

3. The mailbox of claim 2, wherein said housing further comprises a generally horizontal separation panel, wherein said panel is joined along its common horizontal edges to the front, side, and rear panels of the housing intermediate the bottom panel and the top panel for defining the top compartment and the bottom compartment within the housing, wherein said top compartment and said bottom compartment are separate from one another.

4. The mailbox of claim 3, wherein said mail slot is parallel to and spaced below said separation panel.

5. The mailbox of claim 1, wherein said flap is biased in a closed position on the mail slot and is sized and shaped to be yieldably urged open as mail and deliveries are passed through the mail slot into the bottom compartment of the housing.

6. The mailbox of claim 1, wherein said opening defined in the housing is recessed, and wherein said lockable door is fitted within the recess flush with the surface of the housing.

7. The mailbox of claim 1, wherein said locking means comprises a cylinder lock.

8. The mailbox of claim 1, wherein said locking means comprises a hasp and a padlock removably received on said hasp.

9. The mailbox of claim 1, further comprising at least one post support bracket mounted on the exterior of the housing for supporting the mailbox on a support post extending upward from the ground.

10. A locking mailbox for receiving mail and other deliveries, to include newspapers and magazines, in a weather and theft resistant housing, comprising:

a generally upright housing, the housing having a top compartment and an enclosed bottom compartment;

an elongated mail slot defined in the bottom compartment for passing mail and deliveries into the bottom compartment, said slot being located in the top of the bottom compartment in spaced relationship to the top compartment;

an elongated flap sized and shaped to cover the mail slot, the flap being pivotally supported on the inside of the housing in overlapping fashion over the mail slot, wherein said flap is biased in a closed position on the mail slot and is sized and shaped to be urged yieldably open as mail and deliveries are passed through the mail slot into the bottom compartment of the housing;

a generally rectangular opening defined in the bottom compartment, wherein said opening is recessed into the housing;

a lockable door sized and shaped to fit flush with the surface of the housing within said recessed opening, the door being pivotally supported on the housing, the door including locking means for locking the door in a closed position on the housing;

wherein the top compartment is formed as a tubular body having an open end on the side of the housing in which said mail slot is defined and a closed end on the side of the housing facing away from the mail slot for holding outgoing mail in the top compartment;

a protective lip formed as a portion of the top compartment, said lip extending beyond the housing for sheltering the mail slot from the elements;

whereby outgoing mail can be placed under cover in the top compartment awaiting pick up by the postal service, while mail and other deliveries are passed through the mail slot into the bottom compartment and held therein until the locking door of the mailbox is unlocked and opened and the contents of the bottom compartment removed.

* * * * *